US009380370B2

(12) United States Patent
Lowry

(10) Patent No.: US 9,380,370 B2
(45) Date of Patent: Jun. 28, 2016

(54) EARPHONE AND ADAPTER FOR AN EARPHONE

(71) Applicant: Auria LLC, Malvern, PA (US)

(72) Inventor: David Lowry, Wayne, PA (US)

(73) Assignee: Auria LLC, Malvern, PA (US)

( * ) Notice: Subject to any disclaimer, the term of this patent is extended or adjusted under 35 U.S.C. 154(b) by 0 days.

(21) Appl. No.: 14/559,353

(22) Filed: Dec. 3, 2014

(65) Prior Publication Data

US 2015/0156579 A1 Jun. 4, 2015

Related U.S. Application Data

(60) Provisional application No. 61/911,196, filed on Dec. 3, 2013.

(51) Int. Cl.
*H04R 1/10* (2006.01)

(52) U.S. Cl.
CPC ..... *H04R 1/1016* (2013.01)

(58) Field of Classification Search
CPC ..... H04R 1/10; H04R 1/1016; H04R 1/105; H04R 1/1066; H04R 25/652; H04R 25/658; H04R 2420/07; H04R 2225/025
USPC ..... 381/380
See application file for complete search history.

(56) References Cited

U.S. PATENT DOCUMENTS 2,203,105 A * 6/1940 Roberts ..... H04R 1/1016 264/222
2,596,351 A * 5/1952 Weaver ..... H04R 25/04 181/135
2,904,640 A 9/1959 Dreher
6,810,987 B1 * 11/2004 DeKalb ..... 181/129
6,819,762 B2 * 11/2004 Jones et al. ..... 379/430
7,379,557 B2 5/2008 Chou
7,986,803 B1 7/2011 DeKalb
8,111,861 B2 2/2012 Lowry
8,374,375 B2 2/2013 Hu
8,406,447 B2 3/2013 Kromann et al.
8,526,600 B2 9/2013 Howes et al.
9,264,792 B2 * 2/2016 Mainini ..... H04R 1/105
2008/0144877 A1 6/2008 Ham et al.
2009/0141921 A1 * 6/2009 Perkins ..... H04R 25/652 381/328
2010/0027824 A1 * 2/2010 Atamaniuk ..... H04M 1/05 381/322
2012/0039500 A1 * 2/2012 Silvestri ..... H04R 1/1016 381/380
2012/0140967 A1 * 6/2012 Aubert ..... H04R 25/456 381/325
2013/0177193 A1 7/2013 Orzel et al.
(Continued)

*Primary Examiner* — Davetta W Goins
*Assistant Examiner* — Jasmine Pritchard
(74) *Attorney, Agent, or Firm* — Panitch Schwarze Belisario & Nadel LLP

(57) ABSTRACT

An earphone device configured to be removably secured within an ear of a user includes a main body having a base wall and a longitudinal axis, a first projection extending outwardly away from the base wall perpendicular to the longitudinal axis, and a second projection formed at a position spaced apart from the first projection and extending outwardly away from the base wall parallel to the longitudinal axis. The second projection has a tearshaped body tapering from a distal first end toward a proximal second end which defines a single connection point with the base wall. An opening is formed through the tearshaped body. In a use position, the first projection extends inwardly toward the internal cavity of the ear and the second projection deforms to conform to the antihelix of the ear, such that movement of the earphone device relative to the internal cavity of the ear is limited.

9 Claims, 3 Drawing Sheets

(56) References Cited

U.S. PATENT DOCUMENTS

2013/0195310 A1 8/2013 Lin
2014/0211977 A1 7/2014 Armstrong
2014/0241563 A1 8/2014 Monahan et al.
2014/0307911 A1 10/2014 Inoda
2016/0007110 A1* 1/2016 Silvestri ..... H04R 1/2849 381/380

* cited by examiner

EARPHONE AND ADAPTER FOR AN EARPHONE

CROSS-REFERENCE TO RELATED APPLICATIONS

This application claims priority to U.S. Provisional Patent Application No. 61/911,196, filed on Dec. 3, 2013, entitled "Earphone and Adapter for an Earphone," the entire contents of which are incorporated by reference herein.

BACKGROUND OF THE INVENTION

The present invention relates to an earphone, and more specifically to an adapter for an earphone that secures the earphone within a cavity or pocket of the ear of a user.

Conventional earphones that fit in a cavity or pocket proximate an acoustic meatus of an external ear such that the earphone remains in the ear are known. Some earphones, such as those that are bundled with Apple's iPod® and other media devices, rest in the pocket formed between the tragus, the antitragus and the acoustic meatus of the ear. However, because ears differ greatly in size and shape among different users and the earphones do not attach to the ear, such conventional earphones may unintentionally detach from a user's ear or may become displaced within the cavity of the user's ear.

U.S. Pat. No. 8,111,861 discloses an earphone having a base with adjustable tragus arms for securing the earphone to the tragus and anti-tragus of the ear and for attaching to differently sized ears. The base of the earphone of U.S. Pat. No. 8,111,861 prevents lateral (i.e., side to side) movement or displacement of the earphone and also prevents movement or displacement of the earphone in a downward direction toward the lobule of the ear.

In order to provide even greater security against movement of the earphone in either the upwards or longitudinal direction away from the lobule and toward the antihelix of the ear, it would be desirable to provide an earphone or an adapter for an earphone which remains secured in place within the cavity of a user's ear, such that upward movement or displacement of the earphone is prevented, and which is configured to be used with differently sized ears.

BRIEF SUMMARY OF THE INVENTION

One aspect of the present invention is directed to an earphone device configured to be removably secured within an ear of a user. The earphone device comprises a main body having a base wall and a longitudinal axis; a first projection extending outwardly away from the base wall generally perpendicular to the longitudinal axis, the first projection having a first open end distal from the base wall and a second open end proximal the base wall; and a second projection formed at a position spaced apart from the first projection and extending outwardly away from the base wall generally parallel to the longitudinal axis. The second projection has a first end distal from the base wall, a second end proximal the base wall, a tearshaped body tapering from the first end toward the second end, and an opening formed through the tearshaped body. The second end defines a single connection point with the base wall. In a use position, the first projection extends inwardly toward the internal cavity of the ear and the second projection deforms to conform to the antihelix of the ear, such that movement of the earphone device relative to the internal cavity of the ear is limited.

BRIEF DESCRIPTION OF THE SEVERAL VIEWS OF THE DRAWINGS

The following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
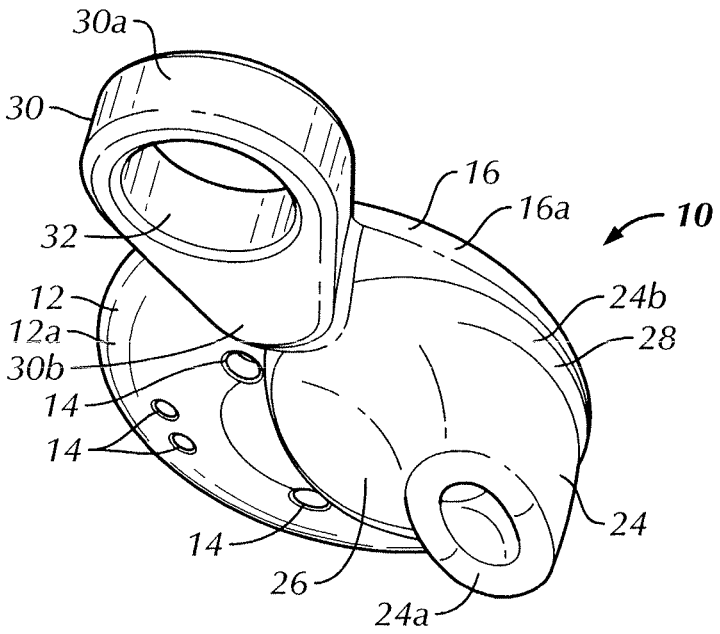
FIG. 1 is a top perspective view of an earphone adapter in accordance with a preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the device and designated parts thereof. The terminology includes the above-listed words, derivatives thereof, and words of similar import. Additionally, the words "a" and "an", as used in the claims and in the corresponding portions of the specification, mean "at least one."

Referring to the drawings in detail, wherein like numerals and characters indicate like elements throughout, there is shown in FIGS. 1-5 a presently preferred embodiment of an adapter for an earphone in accordance with the present invention.

With reference to FIGS. 1-5, the adapter, generally designated 10, may be removably attached to or integrally formed with earphones of various configurations. Preferred types of earphones are available from Auria LLC, the assignee of the present invention, and are disclosed in Auria's U.S. Pat. No. 8,111,861, the entirety of the disclosure of which is hereby incorporated by reference herein. Specifically, the adapter 10 may be integrally formed with any of the earphones or may be a separate component which is removably attachable to any of the earphones described in Auria's U.S. Pat. No. 8,111,861. More particularly, the adapter 10 may be co-molded with the base of any of the earphones or may be a separate component which is removably attachable to the base of any of the earphones described in Auria's U.S. Pat. No. 8,111,861. It will be understood that the earphone adapter 10 may alternatively be integrally formed with or removably attached to any conventional and known earphone.

In one embodiment, the earphone to which the adapter 10 is connected or with which the adapter 10 is integrally formed, preferably includes all of the components described in Auria's U.S. Pat. No. 8,111,861, specifically a speaker housing for enclosing a speaker and electrical components, a wire housing for housing electrical wiring extending from the speaker housing and encased in a protective sheath, and a base mounted to the speaker housing. As described in Auria's U.S. Pat. No. 8,111,861, the base preferably includes a projection and/or one or more tragus lobes for holding the earphone within the cavity of the ear and preventing lateral movement of the earphone therein.

Figure 2:
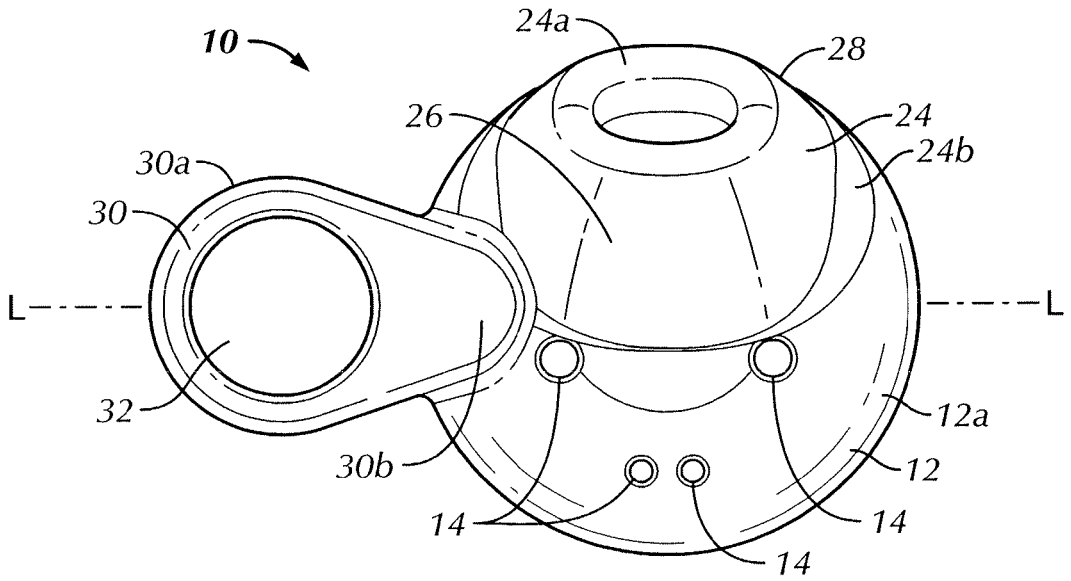
FIG. 2 is a top plan view of the earphone adapter shown in FIG. 1.
Figure 3:
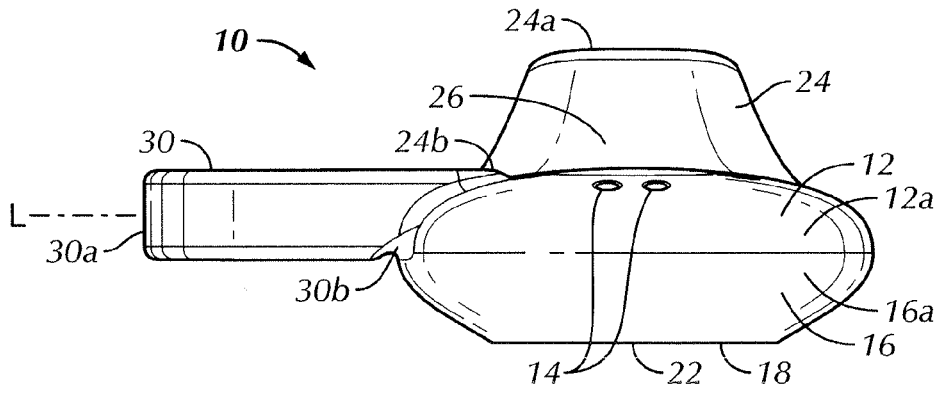
FIG. 3 is a front elevational view of the earphone adapter shown in FIG. 1.

With particular reference to FIGS. 1-3, the adapter 10 comprises a main body 11 having a base wall 12 having a generally circular cross-sectional shape. Preferably, the base wall 12 includes at least one, and more preferably, a plurality of spaced-apart vents 14 which extend from an exterior surface 12*a* of the base wall 12 to an opposing interior surface 12*b* of the base wall 12 (see FIG. 4A). A peripheral sidewall 16 extends around and outwardly away from the base wall 12. The peripheral sidewall has an exterior surface 16*a* and an opposing interior surface 16*b* (see FIG. 4A). Preferably, the peripheral sidewall 16 has a generally frustoconical or tapered tubular shape. A distal end or edge 18 of the peripheral sidewall 16 forms a rim, preferably a generally circular rim, of the adapter 10 which surrounds an access opening or aperture 22. An interior cavity 20 of the adapter 10 is thus defined by the rim 18, the interior surface 12*b* of the base wall 12 and the interior surface 16*b* of the peripheral sidewall 16 (see FIG. 4A).

Figure 6:
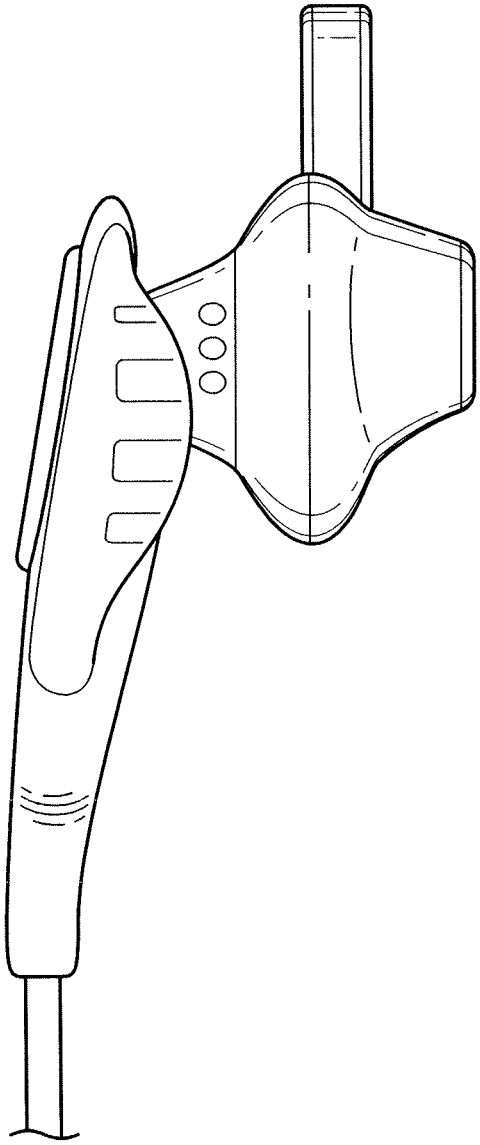
FIG. 6 is a side elevational view of the earphone adapter shown in FIG. 1 assembled onto an earphone.

In one embodiment, the rim 18 of the adapter 10 may be press or snap fit onto an outer periphery of an earphone, such as one of the earphones described in Auria's U.S. Pat. No. 8,111,861, such that the earphone is removably received within interior cavity 20 of the adapter 10 through the access opening 22, with the speaker cover being proximate to or in contact with the interior surface 12*b* of the base wall 12 (see FIGS. 5-6). It will be understood by those skilled in the art that the dimensions of the rim 18 and the interior cavity 20 may vary such that the adapter 10 is configured to be coupled with speaker covers and earphones of varying sizes. In another embodiment, the adapter 10 may be co-molded with an earphone base, such as one of the earphone bases described in Auria's U.S. Pat. No. 8,111,861.

The adapter 10 further includes a first projection 24 extending generally perpendicularly from the base wall 12. More particularly, the first projection 24 extends outwardly away from the base wall 12 in a direction that is generally perpendicular to a longitudinal axis L of the adapter 10 (see FIGS. 2-3). The longitudinal axis L of the adapter 10 is generally parallel to a longitudinal axis (not shown) of a user's ear (not shown) extending from an upper or top end of the ear to an opposing lower or bottom end of the ear. As shown in FIGS. 1-2, the first projection 24 has a generally ovular or elliptical cross-sectional shape, and has a first open end 24*a* distal from the base wall 12 and a second open end 24*b* proximal the base wall 12.

Figure 4:
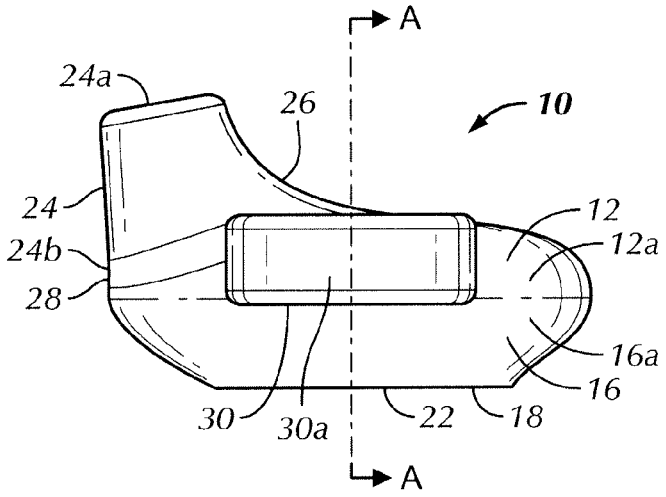
FIG. 4 is left side elevational view of the earphone adapter shown in FIG. 1.
Figure 4A:
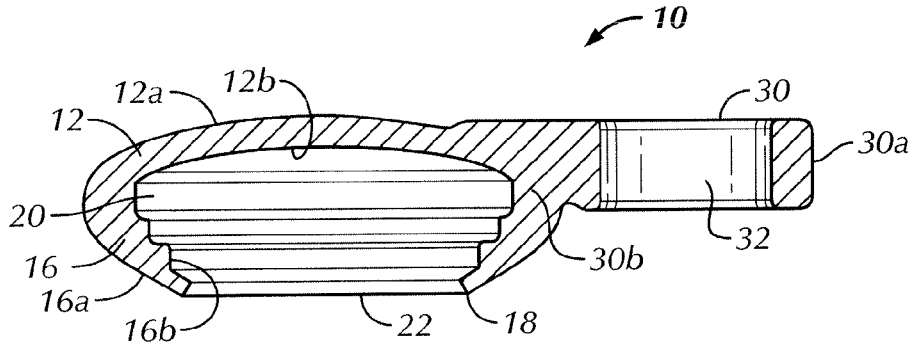
FIG. 4A is a rear cross-sectional elevational view of the earphone adapter shown in FIG. 1 taken along line A-A in FIG. 4.
Figure 5:
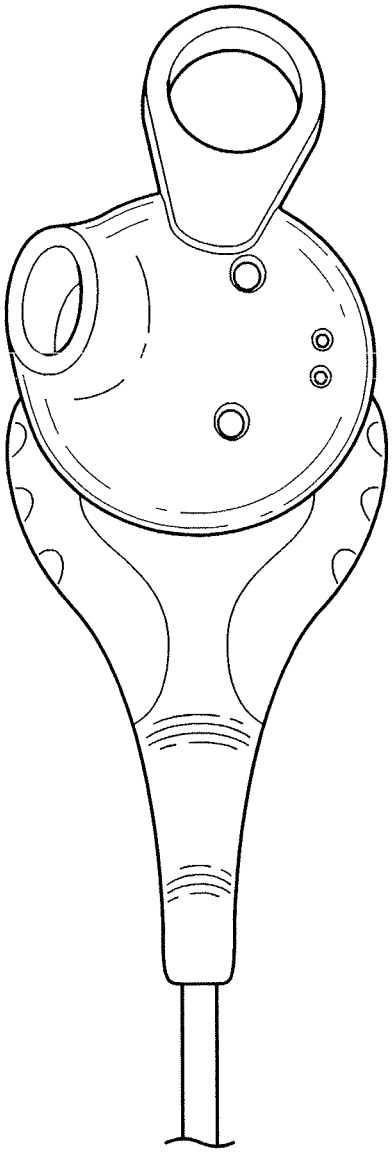
FIG. 5 is top plan view of the earphone adapter shown in FIG. 1 assembled onto an earphone.

Preferably, at least a first side or portion 26 of the proximal end 24*b* of the first projection 24 is integrally formed (and more preferably co-molded) with the base wall 12 and at least a second side or portion 28 of the proximal end 24*b* of the first projection 24 is preferably integrally formed (and more preferably co-molded) with the sidewall 16. As such, at one end of the adapter 10, the base wall 12 and the sidewall 16 transition into the first projection 24. More particularly, at the point of transition between the base wall 12 and the first portion 26 of the proximal end 24*b* of the first projection 24, the first portion 26 of the first projection 24 is generally sloped or angled, as shown in FIGS. 1-4. At the point of transition between the sidewall 16 and the second portion 28 of the proximal end 24*b* of the projection 24, the second portion of the first projection 24 extends in a generally straight configuration, as shown in FIGS. 1 and 4.

At a position spaced apart from the first projection 24, the adapter 10 preferably further includes a second projection 30 extending generally perpendicularly from the base wall 12. Preferably, the second projection 30 is formed at a position approximately about 90° to 180°, more preferably approximately 120° to 135°, and most preferably approximately 90° relative to the first projection 24. However, it will be understood by those skilled in the art that the first and second projections 24, 30 may be formed at any positions relative to each other.

The second projection 30 preferably extends outwardly away from the base wall 12 in a direction that is generally parallel to the longitudinal axis L of the adapter 10 and generally perpendicular to the direction of extension of the first projection 24 (see FIGS. 2-3). Preferably, the second projection 30 has a first end 30*a* distal from the base wall 12 and a second end 30*b* proximal the base wall 12.

More particularly, a width $W_a$ of the distal first end 30*a* of the second projection 30 is larger than a width $W_b$ of the proximal second end 30*b*, such that the second projection has a body that tapers from the first end 30*a* toward the second end 30*b* which is preferably connected to the base wall 12 (see FIG. 2). More particularly, the body of the second projection 30 has a teardrop shape. That is, a first portion of the body of the second projection 30 comprising the proximal second end 30*b* has a frustoconical shape and a second portion of the body of the second projection 30 comprising the distal first end 30*a* has a semi-circular shape. More preferably, the proximal second end 30*b* of the second projection 30 is integrally formed with (and more preferably co-molded with) the base wall 12. Thus, the second projection 30 is attached to or formed with the base wall 12 at a single connection point formed at the second end 30*b*, and more particularly a single tapered connection point 30*b*. The single connection point 30*b* at the tip of the teardrop shaped second projection 30 enables the second projection 30 to be easily deformed and pivoted in the lateral orientation (e.g., from side to side) as necessary to conform to the antihelix (ridge) of a user's ear, and also ensures that the downward force applied by a user's ear (and more particularly the antihelix of the user's ear) when the adapter 10 is in use is translated into and through only the single connection point 30*b*.

The body of the second projection 30 also preferably includes an opening or aperture 32 extending therethrough. In one embodiment, the aperture 32 has a circular cross-sectional shape. The opening 32 allows the second projection 30 to be easily deformed in a variety of configurations, directions and the like. More particularly, the second projection 30 may be longitudinally deformed by bringing the first and second ends 30*a*, 30*b* toward each other and closing the opening 32.

When the adapter 10 is positioned on an earphone (i.e., such that the speaker cover is proximate to or in contact with the interior surface 12*b* of the base wall 12) and the earphone and adapter 10 assembly is positioned within a user's ear, the anatomy of the ear preferably at least slightly holds or compresses the adapter 10 therebetween to more securely mount the earphone within the user's ear and prevent the earphone from unintentionally disconnecting from or becoming displaced in the ear cavity or ear canal. More particularly, when the adapter 10 is positioned within a user's ear, the first projection 24 extends inwardly toward and possibly into the internal cavity (i.e., ear canal) of the user's ear and helps to limit movement or displacement, and more particularly any lateral movement or displacement, of the earphone within the user's ear. The second projection 30 extends upwardly toward the upper ridge, and more particularly, the antihelix of the user's ear and is positioned between the upper ridge (i.e., the antihelix) and the antitragus of the user's ear. More preferably, the second projection 30 directly contacts the upper ridge of the user's ear and may be deformed or moved in any direction, and more preferably in either the left or right direction, so as to conform to the antihelix of the user's ear. Accordingly, the adapter 10 can be accommodated within ears of differing sizes and contours.

More particularly, the second projection 30 may pivot at least slightly in either the left or right direction perpendicular to the longitudinal axis L of the adapter 10. As such, the second projection 30 (and more particularly the distal first end 30*a* of the second projection 30) contacts the antihelix of the ear, thereby limiting movement or displacement, and more particularly any longitudinal movement or displacement, of the adapter 10 within the user's ear. Specifically, the second projection 30 limits any upward longitudinal movement of the adapter 10 relative to the user's ear canal.

In addition to limiting upward longitudinal movement of the adapter 10, the first and/or second projections 24, 30 limit lateral movement of the adapter 10 relative to the user's ear canal. More particularly, in the use position, the first and/or second projections 24, 30 limit movement of the adapter 10 in a direction that is horizontal (e.g., approximately 90°) relative to the user's ear canal. The limiting of any lateral movement occurs because a component of the force transmitted to the adapter 10 when it is compressed within the anatomy of a user's ear serves to push the adapter 10 at least slightly backward toward or even into the ear canal. As such, the first and second projections 24, 30 ensure that the adapter 10 remains secured within the user's ear canal until it is manually removed by the user.

The adapter 10 is preferably constructed of an elastomeric, pliant and/or resilient material, such as a polymer (e.g., plastic) or rubber material, to alleviate pressure on the anatomy of the ear and to ensure that the adapter 10 is flexible and deformable as necessary to be accommodated within ears of different sizes and contours. In a preferred embodiment, the adapter 10 is constructed of a rubber material having a Shore A hardness of approximately 25. However, it will be understood that the adapter 10 may be constructed of any resilient material, such as foam, and may be integrally formed with a base of an earphone.

It will also be appreciated by those skilled in the art that changes could be made to the embodiments described above without departing from the broad inventive concept thereof. Also, based on this disclosure, a person of ordinary skill in the art would further recognize that the relative proportions of the components illustrated could be varied without departing from the spirit and scope of the invention. It is understood, therefore, that this invention is not limited to the particular embodiments disclosed, but it is intended to cover modifications within the spirit and scope of the present invention as defined by the appended claims.

I claim:

1. An earphone device configured to be removably secured within an ear of a user, the ear having an antihelix, the earphone device comprising:

a main body having a base wall and a longitudinal axis;

a first projection extending outwardly away from the base wall generally perpendicular to the longitudinal axis, the first projection having a first open end distal from the base wall and a second open end proximal the base wall; and a second projection formed at a position spaced apart from the first projection and extending outwardly away from the base wall generally parallel to the longitudinal axis, the second projection having a first end distal from the base wall, a second end proximal the base wall, a body tapering from the first end toward the second end, and an opening formed through the body, a first portion of the body which comprises the second end having a frustoconical shape and a second portion of the body which comprises the first end having a semi-circular shape, the second end defining a single connection point with the base wall;

wherein in a use position, the first projection extends inwardly toward the internal cavity of the ear and the second projection deforms to conform to the antihelix of the ear, such that movement of the earphone device relative to the internal cavity of the ear is limited.

2. The earphone device of claim 1, wherein in the use position, the first projection extends into the internal cavity of the ear.

3. The earphone device of claim 1, wherein the second projection is deformable in a longitudinal direction and is pivotable in a lateral direction.

4. The earphone device of claim 1, wherein the earphone device is made of an elastomeric material.

5. The earphone device of claim 4, wherein the earphone device is made of a rubber material having a Shore A hardness of approximately 25.

6. The earphone device of claim 1, further comprising a plurality of spaced-apart vents extending through the base wall.

7. The earphone device of claim 1, wherein the first projection and/or the second projection limit movement of the earphone device in both the longitudinal and lateral directions relative to the internal cavity of the ear.

8. The earphone device of claim 1, wherein the opening has a circular cross-sectional shape.

9. The earphone device of claim 1, wherein the second projection is longitudinally deformable by bringing the first and second ends toward each other.

* * * * *